US006132526A

United States Patent [19]

Carisey et al.

[11] Patent Number: 6,132,526

[45] Date of Patent: Oct. 17, 2000

[54] TITANIUM-BASED INTERMETALLIC ALLOYS

[75] Inventors: Thierry Eric Carisey, Chatres de Bretagne, France; Dipankar Banerjee, Hyderabad, India; Jean-Michel Franchet, Paris, France; Ashok Kumar Gogia, Hyderabad, India; Alain Lasalmonie, L'Hay les Roses, France; Tapash Kumar Nandy, Hyderabad, India; Jean-Loup Strudel, Cerny, France

[73] Assignees: Societe Nationale d'Etude et de Construction de Moteurs d'Aviation "SNECMA", Paris, France; Chief Controller Research and Development Defence Research and Development Organisation Ministry of Defence Govt of India, Hyderabad, India; Association pour la Recherche et le Developpement des Methodes et Processus Industriels A.R.M.I.N.E.S., Paris, France

[21] Appl. No.: 09/213,247

[22] Filed: Dec. 17, 1998

[30] Foreign Application Priority Data

Dec. 18, 1997 [FR] France ..... 97 16057

[51] Int. Cl.[7] ..... C22C 14/00

[52] U.S. Cl. ..... 148/407; 148/421; 148/671; 420/421; 420/418

[58] Field of Search ..... 420/418, 421; 148/671, 407, 421

[56] References Cited

U.S. PATENT DOCUMENTS

| | | | |
|---|---|---|---|
| 5,284,618 | 2/1994 | Allouard et al. | 420/426 |
| 5,417,779 | 5/1995 | Griebel, III et al. | 148/421 |
| 5,447,582 | 9/1995 | Eylon et al. | 148/669 |

*Primary Examiner*—George Wyszomierski
*Assistant Examiner*—Jannelle Combs Morillo
*Attorney, Agent, or Firm*—Oblon, Spivak, McClelland, Maier & Neustadt, P.C.

[57] ABSTRACT

A titanium-based intermetallic alloy having a high yield stress, a high creep resistance and sufficient ductility at ambient temperature has the following chemical composition as measured in atomic percentages:

Al, from 16 to 26; Nb, from 18 to 28; Mo, from 0 to 2; Si, from 0 to 0.8; Ta, from 0 to 2; Zr, from 0 to 2; and Ti as the balance to 100; with the condition that Mo+Si+Zr+Ta>0.4%.

Production, working and heat-treatment ranges adapted to the intended use of the material are also defined.

10 Claims, 5 Drawing Sheets

TITANIUM-BASED INTERMETALLIC ALLOYS

BACKGROUND OF THE INVENTION

The present invention relates to a family of titanium-based intermetallic alloys which combine a number of specific mechanical properties comprising high yield stress, high creep strength and sufficient ductility at ambient temperature.

Intermetallic alloys of the $Ti_3Al$ type have been found to exhibit useful specific mechanical properties. Ternary alloys with additions of Nb in particular have been tested and their mechanical properties, combined with a lower density than that of nickel-based alloys (typically between 4 and 5.5 depending on the Nb content) have aroused great interest for aeronautical applications. These alloys furthermore have a greater titanium fire resistance than the Ti-based alloys used previously in the construction of turbomachines. The applications envisaged involve solid structural components such as casings, solid rotating components such as centrifugal impellers, or as a matrix for composites for integrally bladed rings. The desired service temperature ranges are up to 650° C. or 700° C. in the case of components made of a long-fiber composite.

U.S. Pat. No. 4,292,077 and U.S. Pat. No. 4,716,020 describe the results obtained from titanium-based intermetallic alloys containing from 24 to 27% Al and from 11 to 16% Nb in at %.

U.S. Pat. No. 5,032,357 has shown improved results by increasing the Nb content. In this case, the intermetallic alloys obtained generally have a microstructure composed of two phases:

- a niobium-rich B2 phase forming the matrix of the material and providing ductility at ambient temperature; and
- a so-called O phase, with the defined composition $Ti_2AlNb$, which is orthorhombic and forms lamellae in the B2 matrix. The O phase is present up to 1000° C. and gives the material its hot strength properties in creep and in tension.

However, these known prior alloys have certain drawbacks, particularly an insufficient ductility at ambient temperature and extensive plastic strain during primary creep, which at the present time limit their use.

SUMMARY OF THE INVENTION

The present invention provides a family of titanium-based intermetallic alloys which avoid the drawbacks of the aforementioned known alloys and which are characterized by having the following chemical composition as measured in atomic percentages:

Al, from 16 to 26; Nb, from 18 to 28; Mo, from O to 2; Si, from O to 0.8; Ta, from O to 2; Zr, from O to 2; and Ti as the balance to 100; with the condition that Mo+Si+Zr+Ta>0.4%.

Suitable thermomechanical treatments of these intermetallic alloys according to the invention, together with a method of processing them, are furthermore defined in order to improve their mechanical properties, and in particular to increase their ductility at ambient temperature and to limit the plastic strain during primary creep.

There follows justification for the choices of the compositional ranges adopted, together with a description of the tests carried out which have led to the definition of the production and working process. The description includes an indication of the results obtained in terms of mechanical properties and compared with the properties of known prior alloys.

Other advantages of the present invention will be readily appreciated as the invention is described by way of example with reference to the following drawings.

DESCRIPTION OF THE PREFERRED EMBODIMENTS

The experimental results have shown that the contents adopted for the three major elements of the composition—titanium, aluminum and niobium—are the most appropriate, namely:

Al, from 16 to 26 at %; Nb, from 18 to 28 at %; and Ti as the base element.

The variation in the contents within the limits indicated allows the properties to be adjusted depending on the type of application desired and the corresponding service temperature range.

Specifications with Regard to Al and Si: α-genic Elements

Figure 2:
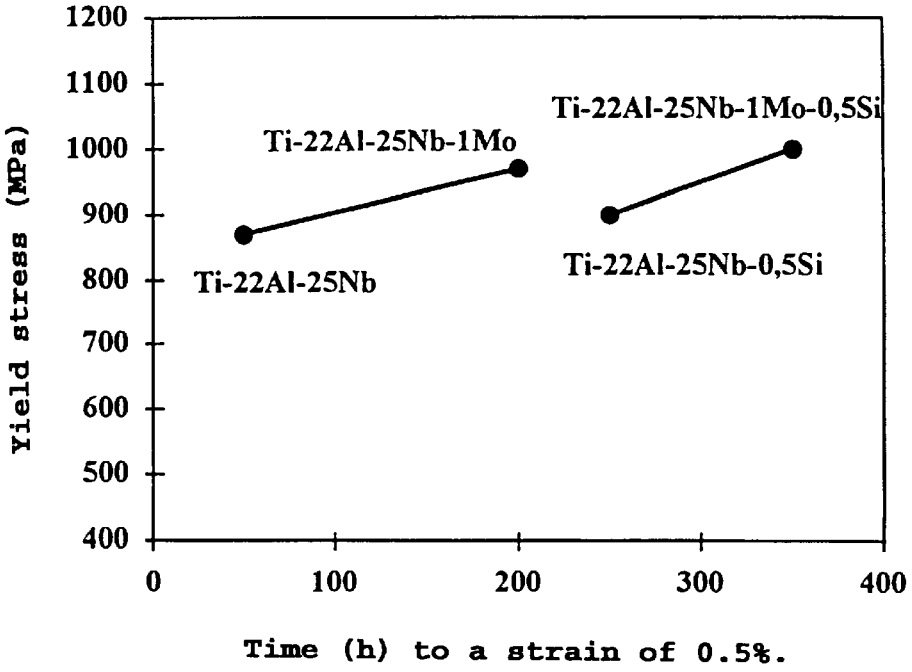
FIG. 2 shows the results of 550° C. creep tests at 500 MPa for various alloy compositions, with the yield stress in MPa plotted on the y-axis and the time in hours to a strain of 0.5% plotted on the x-axis.

These two elements are elements which favor the O phase and therefore they increase the hot strength properties of the alloys. However, they tend to decrease the ductility, particularly at ambient temperature. The plastic strain during primary creep decreases from 0.5% to 0.25w when these elements are added (0.5% Si or an increase in Al content from 22% to 24%). On the other hand, the yield stress is greatly reduced, as is the ductility (from 1.5% to 0.5%). Thus, the increase in aluminum content from 22% to 24%, for the same heat treatment, significantly reduces the yield stress, which falls from 600 MPa to 500 MPa at 650° C. The beneficial influence of the 0.5% Si addition on the creep resistance is illustrated in FIG. 2.

Specifications with Regard to Nb, Mo and Ta: β-genic Elements

Figure 1:
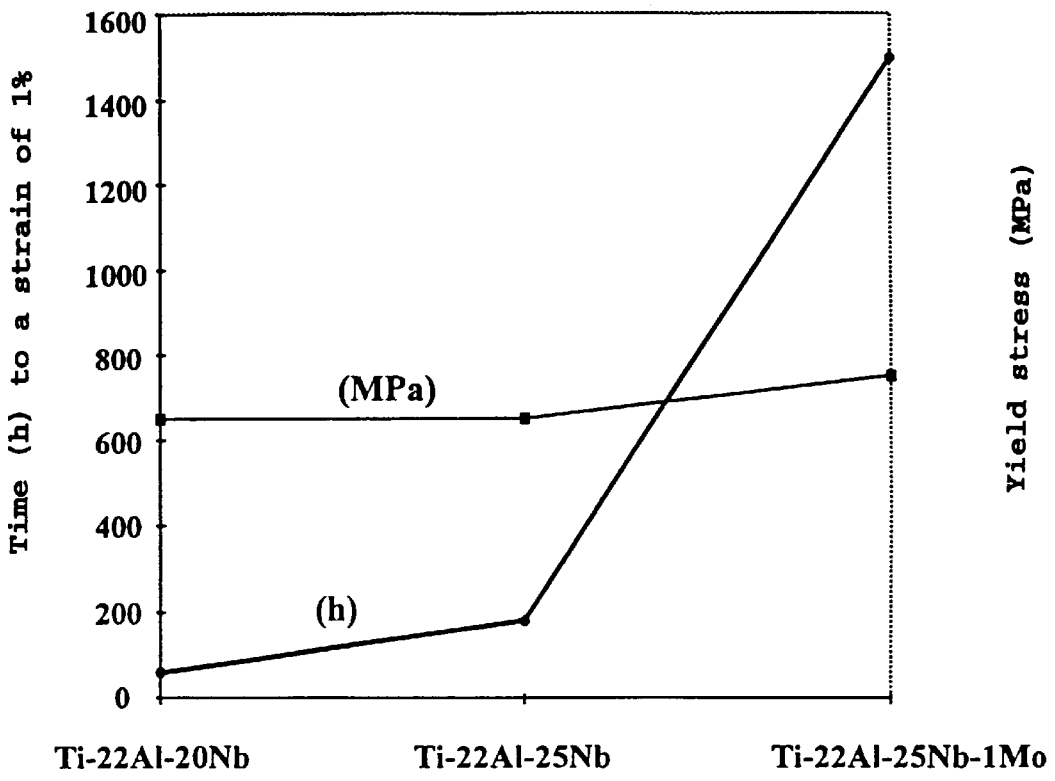
FIG. 1 shows the results of 550° C. creep tests at 500 MPa for various alloy compositions, the time in hours to a strain of 1% being plotted on the left-hand y-axis and the results of tensile tests with the yield stress in MPa being plotted on the right-hand y-axis.

These elements favor the B2 phase, which is ductile at ambient temperature, and they help to stabilise the B2 phase at the service temperatures. Reducing the niobium content (from 25% to 20%) mainly affects the creep resistance, the tensile properties being little modified, as the results given in FIG. 1 show. It will be noted that adding molybdenum significantly increases the yield stress of 100 MPa at ambient temperature and the yield stress of 200 MPa at 650° C., without reducing the ductility at ambient temperature. Molybdenum also improves the creep resistance—it very markedly reduces the plastic strain during primary creep (from 0.5% to 0.25%) and reduces the plastic strain rate during the secondary stage. These benefits are enhanced when the alloy contains silicon beforehand. These results obtained with 550° C. creep at 500 MPa are illustrated in FIG. 2 for alloys having Mo, Si, or both elements, added.

Tantalum is a β-genic element very similar to niobium, with which it is often combined in ores. In titanium alloys, it increases their mechanical strength and gives them better corrosion resistance and oxidation resistance.

Specifications with Regard to Zr: a β-neutral Element

Zirconium is a neutral element, and the methods of production of the alloys and the source of the elements added, by recycling or otherwise, may result in the presence of Zr which in certain cases is desirable.

For the intermetallic alloys of the invention, the atomic percentage adopted in the case of Zr, like in the case of Ta, lies between 0 and 2%.

These specifications and the experimental tests carried out have resulted in the composition of the intermetallic alloys containing, in addition to the three major elements mentioned above, additional elements in the following atomic percentages:

Mo, 0 to 2; Si, 0 to 0.8; Ta, 0 to 2; Zr, 0 to 2; with the condition that at least one of the additional elements should be present such that Mo+Si+Zr+Ta>0.4%.

Production and Working Processes

A production process for the material has also been developed in accordance with the invention and allows the desired mechanical properties described previously to be obtained.

In this production process, the first step consists of homogenising the composition of the material by using, for example, the VAR (Vacuum Arc Remelting) process, this step being important as it determines the homogeneity of the material. Next, the material is deformed at high speed in order to reduce the grain size, either by hammer forging in the β state or by high-speed extrusion, again in the β state. The resultant bars of the material are then cut into slugs for undergoing the final step in the thermomechanical treatment, namely isothermal forging. This isothermal forging is carried out in a temperature range extending from $T_\beta$−125° C. to $T_\beta$−25° C. and at strain rates ranging from $5\times10^{-4}$ $s^{-1}$ to $5\times10^{-2}$ $s^{-1}$. $T_\beta$ is the transition temperature between the β single-phase high-temperature state and the $\alpha_2+B_2$ two-phase state, ($\alpha_2$ being a phase of defined composition, $Ti_3Al$, which transforms into the O phase below 900° C. approximately). $T_\beta$ lies around 1065° C. in the case of a Ti-22%Al-25%Nb alloy, for example.

Depending on the particular applications, the bars obtained by forging or extrusion may, as a variant, be subjected to a rolling operation in which the strain rates are of the order of $10^{-1}$ $s^{-1}$. A precision forging operation may also be carried out in an $\alpha_2+B_2$ two-phase state which results in an equiaxial grain structure with the $\beta_2$/O phase in a spheroidal form. In this case, the forging is carried out in a temperature range extending from $T_\beta$−180° C. to $T_\beta$−30° C.

The production of the material is completed by a heat treatment which consists of three steps.

The first step is a solution treatment step at a temperature of between Tp−35° C. and $T_\beta$+15° C. for less than 2 hours.

The second step allows the hardening phase 0 to grow and this aging is carried out between 750° C. and 950° C. for at least 16 hours.

The third treatment is carried out within a 100° C. temperature range around the service temperature of the material.

The choice of cooling rate between the various temperature holds is important as it determines the size of the lamellae of the hardening phase O. A particular program is determined according to the service properties that it is desired to obtain.

Figure 3:
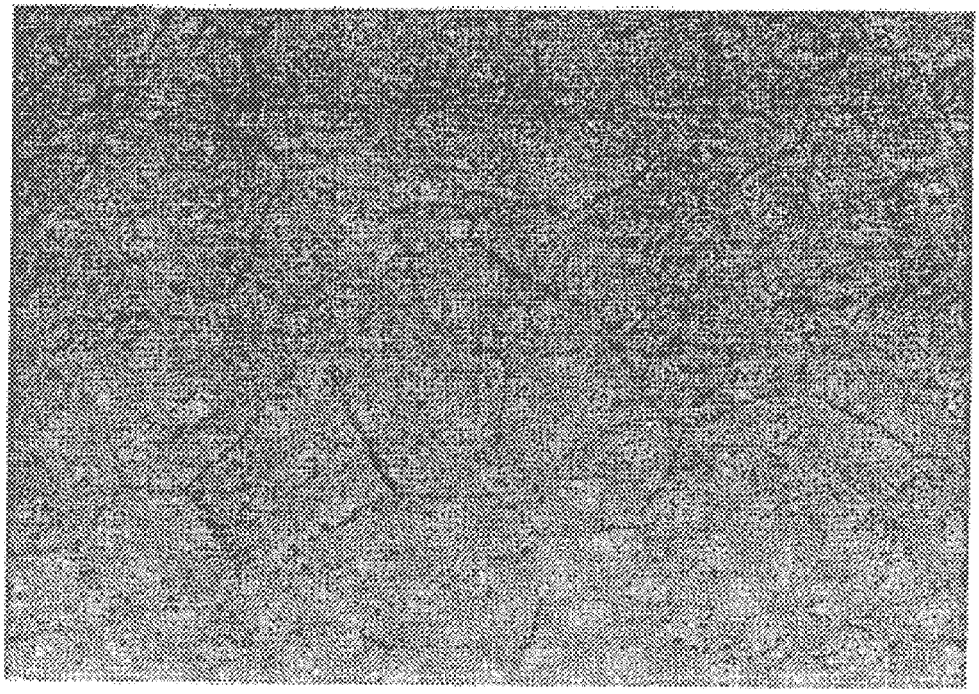
FIG. 3 shows an example of the microstructure obtained after production of an intermetallic alloy according to the invention.

FIG. 3 shows an example of the microstructure obtained after an intermetallic alloy according to the invention has been produced in this way.

If an equiaxial grain structure produced by precision forging in the $\alpha_2+B_2$ state is desired, during the first step of the heat treatment, the solution treatment temperature is close to the forging temperature. The choice of this temperature is critical as it influences both the intended size of the equiaxed grains and the relative proportion of the populations of the remaining spheroidal primary hardening phase and of the needle-shaped secondary hardening phase which will form during the next steps.

In the development work carried out, it has been shown that the thermomechanical treatments greatly influence the mechanical properties:

effect of the forging temperature: high-temperature forging improves the 550° C. creep resistance, the time to breakage being increased by a factor of 10 and the strain at breakage going from 0.8% to 1.3% with a 50° C. increase in forging temperature;

effect of the forging rate: for a 20 times higher rate, a reduction in the time to breakage by a factor of 10 is observed in 550° C. creep at 500 MPa.

The heat treatment near the $T_\beta$ transition temperature causes the $B_2$ grains to recrystallise and significantly increases the 650° C. creep resistance. However, this treatment reduces the yield stress, but does increase the ductility around 350° C. A heat treatment at a temperature further away (−25° C.) from the transition temperature $T_\beta$ increases the yield stress and increases the 550° C. creep resistance. In addition, this treatment allows a ductility plateau of around 10% to be achieved from 200° C. up to 600° C.

These observations result in particular from the following tests:

EXAMPLE 1

Role of the Forging Temperature:

We have looked at the influence of two forging temperatures on the creep resistance. The forging operation is followed by the same high-temperature heat treatment. We will therefore show how the forging temperature has an important effect on the creep resistance as it determines the morphology of the phases present in the material, as the results below of the 550° C. creep resistance at 450 MPa of a Ti alloy containing 22% Al and 25% Nb show:

| FORGING TEMPERATURE | TIME TO 0.5% (h) | TIME TO BREAK (h) | PRIMARY STRAIN (%) | STRAIN RATE ($s^{-1}$) |
|---|---|---|---|---|
| $T_\beta$ - 100° C. | 30.3 | 168 | 0.44 | $5 \times 10^{-9}$ |
| $T_\beta$ - 50° C. | 123.3 | 1037.5 | 0.35 | $2 \times 10^{-9}$ |

Finally, the 650° C. creep resistance at 300 MPa of the Ti-22%Al-25%Nb alloy gives the following results as a function of the isothermal forging temperature:

| FORGING TEMPERATURE | TIME TO 0.5% (h) | TIME TO BREAK (h) | PRIMARY STRAIN (%) | SECONDARY STRAIN RATE ($s^{-1}$) |
|---|---|---|---|---|
| $T_\beta$ - 100° C. | 7 | 980 | 1 | $1 \times 10^{-8}$ |
| $T_\beta$ - 50° C. | 12.7 | 1526 | 0.8 | $6.9 \times 10^{-9}$ |

EXAMPLE 2

Effect of the Heat Treatment;

We will show here the influence of the solutioning temperature on the mechanical properties and the creep resistance, for roller forging at high temperature. We are able to observe that solutioning at a high temperature causes recrystallization and a drop in tensile properties. On the other hand, these two treatments make it possible to choose the temperature at which the material is creep resistant, either at 550° C. or at 650° C. A low solutioning temperature gives good 550° C. creep resistance whereas a higher temperature gives better 650° C. resistance, this applying to all the characteristics, namely time to break, primary plastic strain and strain rate.

The following results were obtained by measuring the yield stress in MPa as a function of the test temperature for two solutioning temperatures:

| TREATMENT TEMPERATURE | 20° C. | 350° C. | 450° C. | 550° C. | 650° C. |
|---|---|---|---|---|---|
| $T_\beta$ - 5° C. (MPa) | 792.4 | 637.6 | 659 | 668 | 505 |
| $T_\beta$ - 25° C. (MPa) | 846.7 | 711.01 | 734.3 | 695 | 645.4 |

Likewise, the following results were obtained by measuring the 550° C. creep resistance at 500 MPa as a function of the temperature of the solutioning treatment:

| TREATMENT TEMPERATURE | TIME TO 0.5% (h) | TIME TO BREAK (h) | PRIMARY STRAIN (%) | STRAIN RATE ($s^{-1}$) |
|---|---|---|---|---|
| $T_\beta$ - 5° C. | 123 | >1000 | 0.37 | $2 \times 10^{-9}$ |
| $T_\beta$ - 25° C. | 211 | 1220 | 0.47 | $1.3 \times 10^{-9}$ |

EXAMPLE 3

Ambient-temperature Ductility Adjustment;

We will now present the ductility obtained at ambient temperature as a function of the temperature of the final heat treatment, the duration of this treatment being between 16 and 48 h. We are able to observe that the higher the temperature of the final treatment, the higher the ductility. These results were obtained on a quaternary alloy containing molybdenum. It is therefore possible, with a suitable treatment, to obtain a ductility tailored to a particular use, as indicated below:

| Final treatment temperature | 900° C. | 750° C. | 600° C. | 550° C. |
|---|---|---|---|---|
| Ductility | 10% | 6.4% | 2.5% | 1.25% |

Specimens of intermetallic alloys having a composition falling within the scope of the invention were tested and have shown improvements in the results obtained compared with the prior known alloy of the Ti-22%Al-25%Nb type composition.

EXAMPLE 4

Effect of Molybdenum;

The table below gives the yield stress at various temperatures and we see clearly the effect of the addition of 1% of Mo on the yield stress. In the second table, we show the advantage of the presence of molybdenum on the creep resistance. The materials were treated using the same thermomechanical treatment. This thermomechanical treatment is characterized by a low-temperature forging operation at $T_\beta$−100° C. and a heat treatment at $T_\beta$−25° C. before a 24 h temperature hold at 900° C. and an aging operation at 550° C. for at least 2 days.

| | YIELD STRESS (MPa) | | | | |
|---|---|---|---|---|---|
| ALLOY | 20° C. | 350° C. | 450° C. | 550° C. | 650° C. |
| Ti-22% Al-25% Nb | 869.5 | 765 | 632 | 640 | 613 |
| Ti-22% Al-25% Nb-1% Mo | 970 | 921 | 839 | 780 | 810 |

| | 550° C. CREEP AT 500 MPa | | | |
|---|---|---|---|---|
| ALLOYS | TIME TO 0.5% (h) | TIME TO BREAK (h) | PRIMARY STRAIN (%) | SECONDARY STRAIN RATE ($s^{-1}$) |
| Ti-22% Al-25% Nb | 56 | 180 | 0.4 | $7.5 \times 10^{-9}$ |
| Ti-22% Al-25% Nb-1% Mo | 200 | >1800 | 0.3 | $8 \times 10^{-10}$ |

EXAMPLE 5

Effect of Silicon;

We show the effect of the addition of silicon on the creep resistance, again using materials produced by applying the thermomechanical treatment described above in Example 4. We thus show the reduction in the plastic strain of the primary creep and the significant reduction in the secondary creep rate.

| ALLOYS | 550° C. CREEP RESISTANCE AT 500 MPa | | | |
|---|---|---|---|---|
| | TIME TO 0.5% (h) | TIME TO BREAK (h) | PRIMARY STRAIN (%) | SECONDARY STRAIN RATE ($s^{-1}$) |
| Ti-22% Al-25% Nb | 56 | 180 | 0.4 | $7.5 \times 10^{-9}$ |
| Ti-22% Al-25% Nb-0.5% Si | 274 | >1000 | 0.3 | $1.9 \times 10^{-9}$ |

EXAMPLE 6

Effect of Tantalum;

Ingots of a Ti-24%Al-20%Nb reference alloy and of a modified alloy having the composition Ti-24%Al-20%Nb-1%Ta, the values being given in at %, were produced and then cylindrical specimens were machined; the heat treatments applied were: 1160° C./30 minutes, furnace cooling down to 750° C. followed by a temperature hold for 24 hours. Mechanical tests in compression gave the following results:

| ALLOY | YIELD STRESS (MPa) | |
|---|---|---|
| | 20° C. | 650° C. |
| Ti-24% Al-20% Nb | 692 | 437 |
| Ti-24% Al-20% Nb-1% Ta | 736 | 442 |

EXAMPLE 7

Effect of Zirconium;

The same operations as in Example 6 for a Ti-24%Al-20%Nb-1%Zr alloy gave the following results:

| ALLOY | YIELD STRESS (MPa) | |
|---|---|---|
| | 20° C. | 650° C. |
| Ti-24% Al-20% Nb-1% Zr | 730 | 478 |

Figure 10:
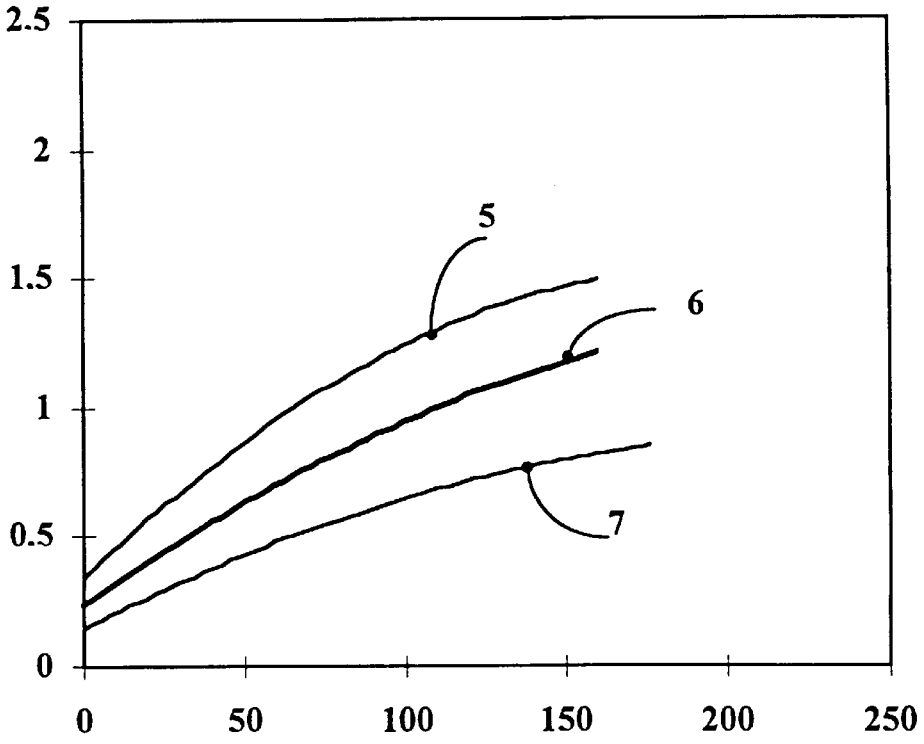
FIG. 10 shows the results of compressive creep tests for a known prior alloy and for two alloys according to the invention.

The compression creep tests in these two examples also show the advantage of the elements Ta and Zr for increasing the creep resistance by a reduction in the primary creep strain and a reduction in the secondary creep rate. The results are plotted in FIG. 10 in the case of 650° C. creep tests in compression at 310 MPa, curve 5 being for the Ti-24%Al-20%Nb alloy, curve 6 being for the Ti-24%Al-20%Nb-1%-Ta alloy and curve 7 being for the Ti-24%Al-20%Nb-1%Zr alloy.

Figure 4:
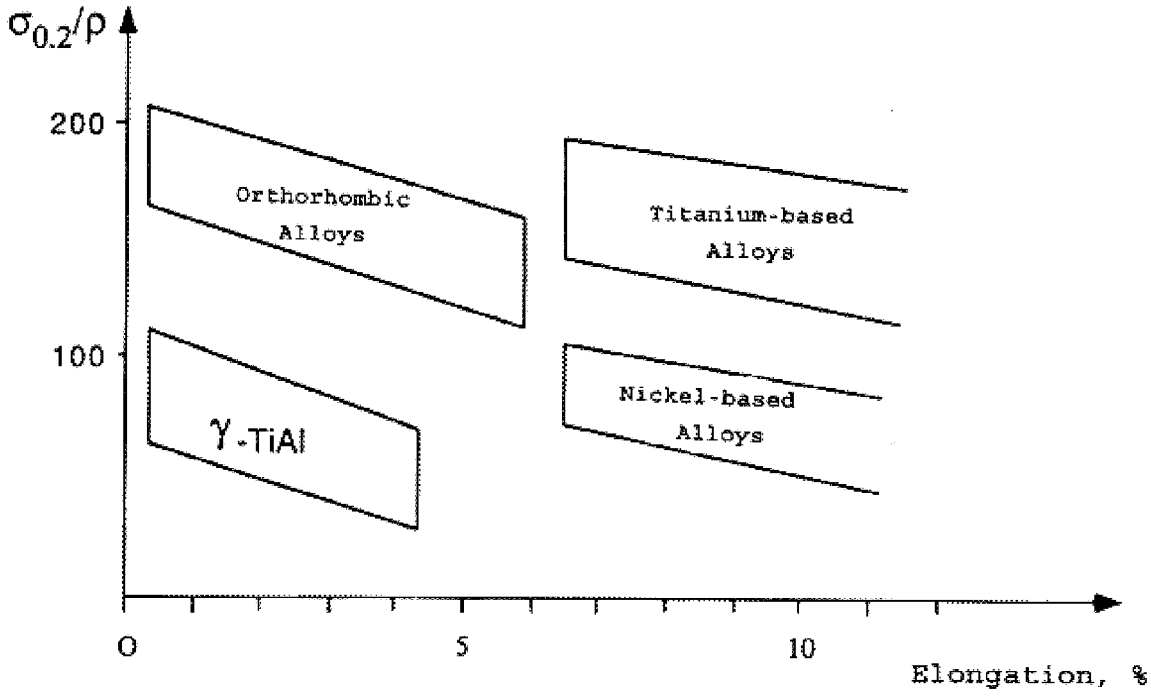
FIG. 4 shows diagrammatically, in zones, the results of mechanical tests carried out at ambient temperature on four different types of alloys, the percentage elongations being plotted on the x-axis and the specific yield stress being plotted on the y-axis.
Figure 5:
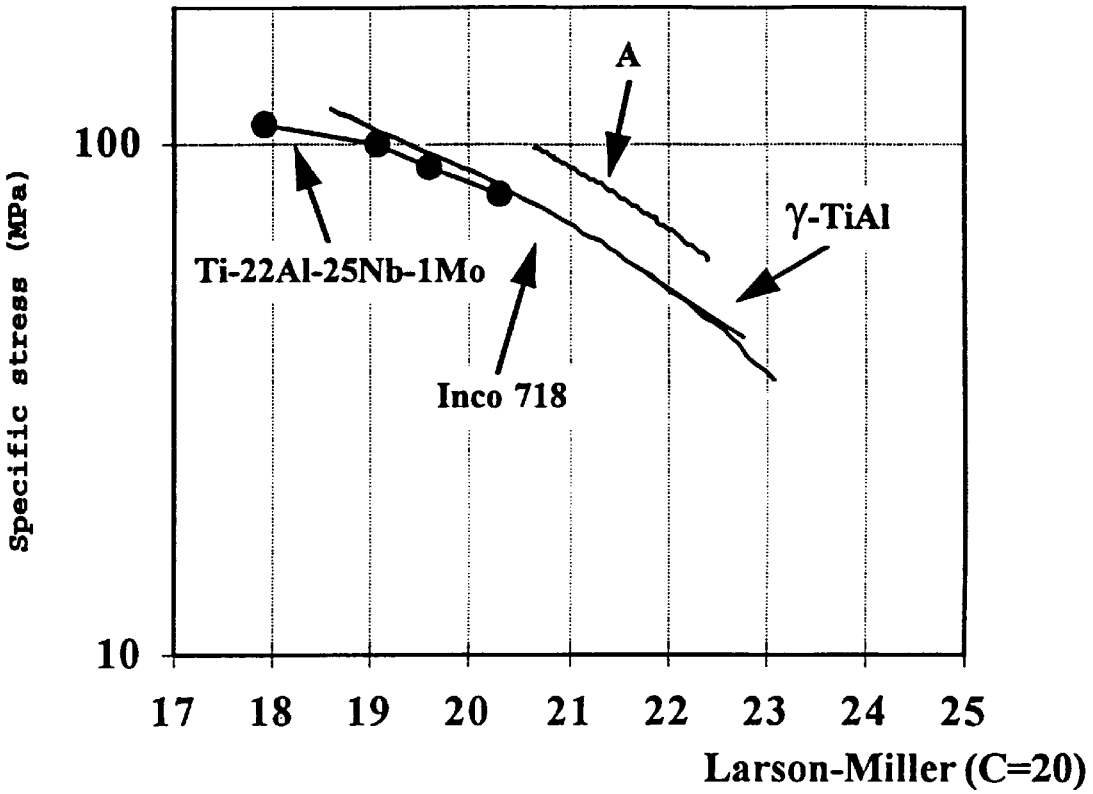
FIG. 5 shows, in the form of a Larson-Miller plot, the creep resistance results to a strain of 1% for various alloys, the Larson-Miller parameter being plotted on the x-axis and the specific stress in MPa plotted on the y-axis.
Figure 6:
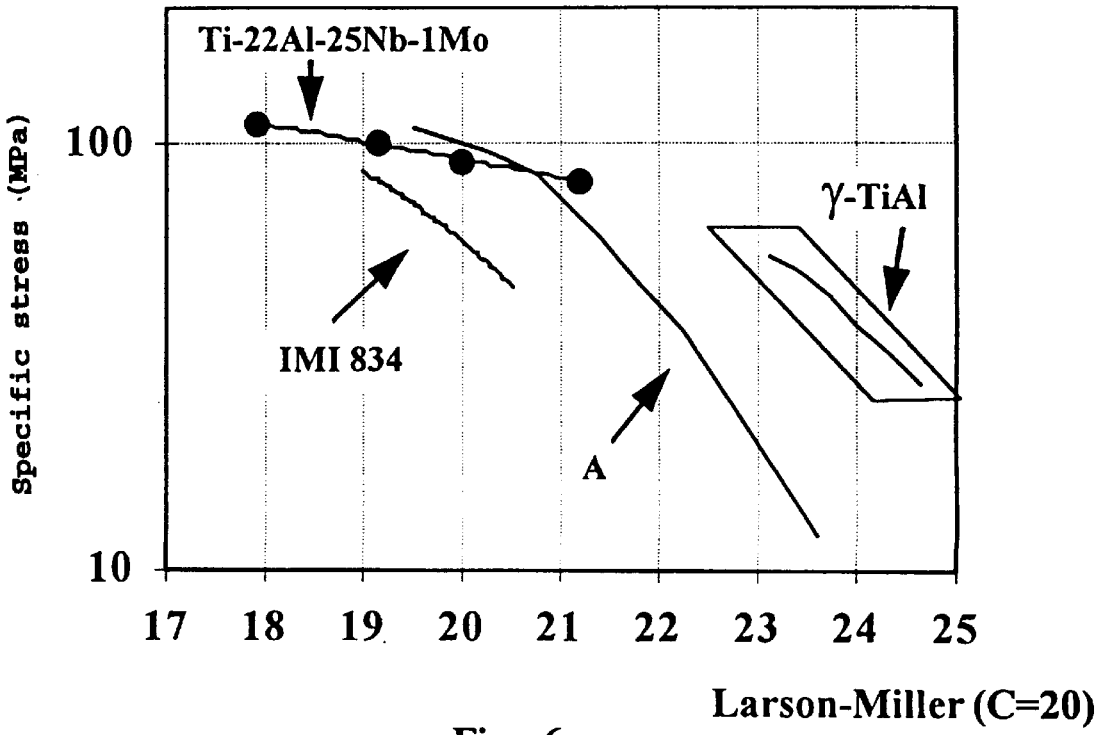
FIG. 6 shows, in the form of a Larson-Miller plot, the creep resistance results to fracture for various alloys, the Larson-Miller parameter being plotted on the x-axis and the specific stress in MPa plotted on the y-axis.

The experimental results obtained show the previously noted advantages of the alloys according to the invention. Furthermore, FIG. 4 compares the specific mechanical properties in tension at ambient temperature of these alloys with those of alloys commonly used in the aeronautical industry, of the nickel-based or titanium-based type, or of alloys under development, such as γ TiAl intermetallics, and these results confirm the advantage of the alloys according to the invention. Likewise, the comparative results of the creep resistance of known nickel-based alloys such as Inco 718 and a nickel-based superalloy A according to EP-A-0,237,378, of titanium-based alloys such as IMI 834 or a γ TiAl intermetallic, and of an alloy according to the invention are plotted in FIGS. 5 and 6 in the form of Larson-Miller plots.

Figure 7:
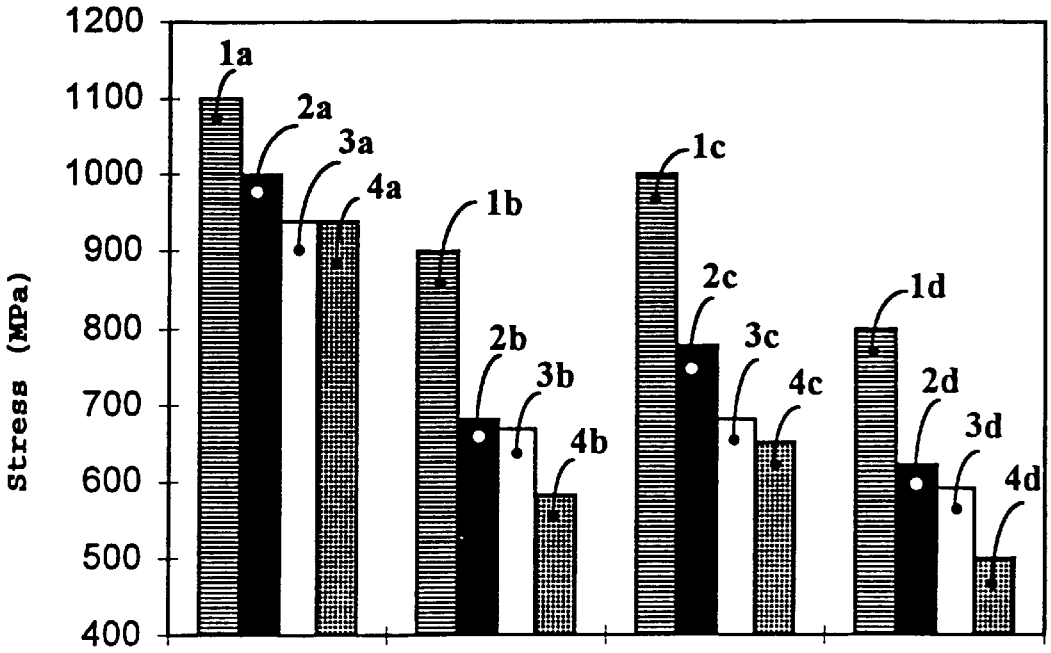
FIG. 7 shows the result of mechanical tests obtained for an alloy according to the invention, showing the stresses in MPa, at fracture and at the yield point, at 20° C. and at 650° C., for four different heat treatment ranges applied to the alloy.
Figure 8:
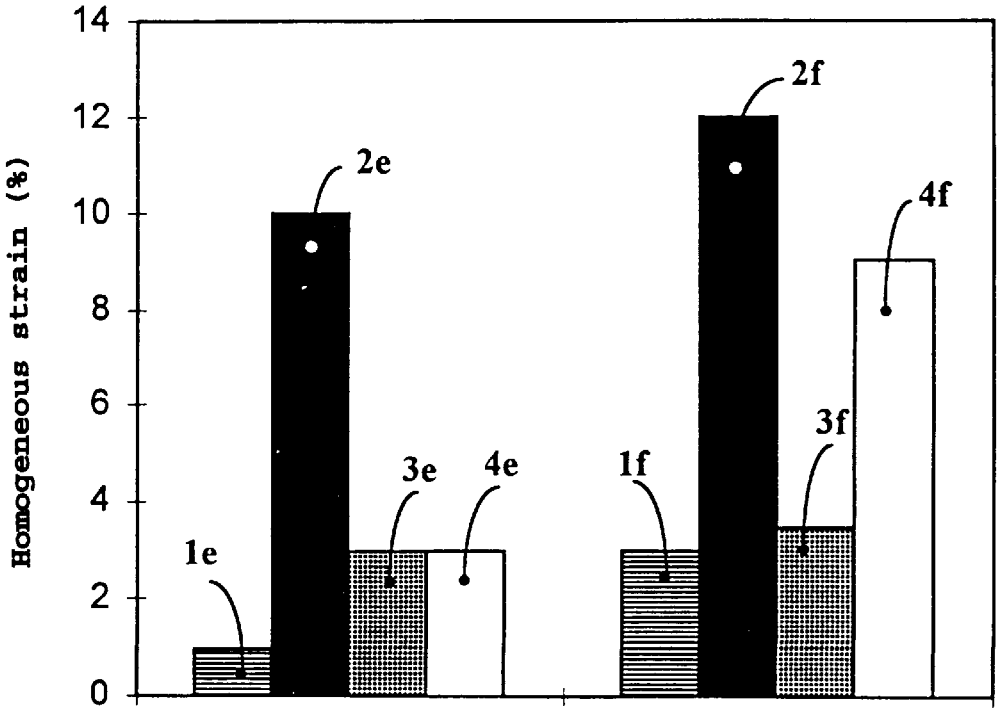
FIG. 8 shows the result of mechanical tests obtained for an alloy according to the invention, showing the homogeneous strain in percent at 20° C. and at 650° C., for four different heat treatment ranges applied to the alloy.
Figure 9:
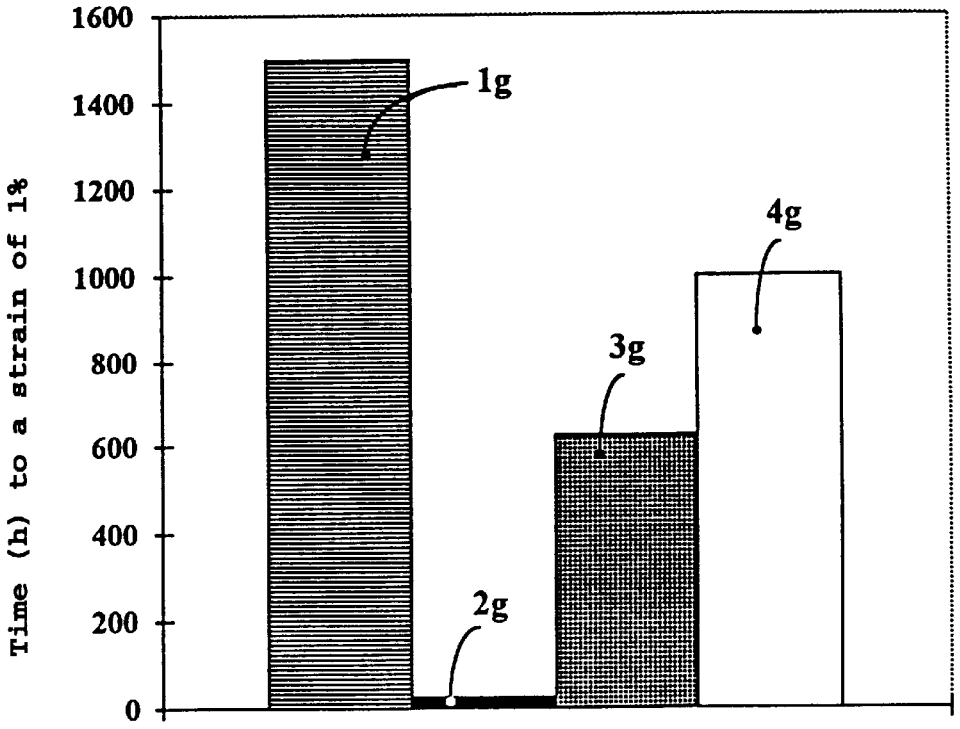
FIG. 9 shows the result of mechanical tests obtained for an alloy according to the invention, showing the time in hours to a strain of 1% in a 550° C. creep test at 500 MPa, for four different heat treatment ranges applied to the alloy.

Finally, the results obtained in mechanical tests on an alloy according to the invention having a composition of 22 at % Al, 25 at % Nb, 1 at % Mo and Ti making up the balance to 100 at % are plotted in the diagrams in FIGS. 7, 8 and 9, in which the levels 1*a* . . . 1*g* correspond to a heat treatment comprising:

solution treatment at 1030° C./1 hour aging at 900° C./24 hours annealing at 550° C./48 hours;

the levels 2*a* . . . 2*g* correspond to the heat treatment:

solution treatment at 1030° C./1 hour aging at 900° C./24 hours the levels 3*a* . . . 3*g* correspond to the heat treatment:

solution treatment at 1060° C./1 hour aging at 900° C./24 hours annealing at 550° C./48 hours:

and the levels 4*a* . . . 4*g* correspond to the heat treatment:

solution treatment at 1030° C./1 hour aging at 800° C./24 hours annealing at 600° C./48 hours

We claim:

1. A titanium-based intermetallic alloy having a composition, comprising:

Al, from 16 to 26 atomic %;

Nb, from 18 to 28 atomic %;

Mo, from 0 to 2 atomic %;

Si, from 0 to 0.8 atomic %;

Ta, from 0 to 2 atomic %;

Zr, from 0 to 2 atomic %;

Ti, balance to 100 atomic %;

wherein Mo+Si+Zr+Ta>0.4 atomic %; and wherein said alloy has an O phase structure.

2. An intermetallic alloy as claimed in claim 1, produced by a process, comprising:

a) melting of said composition to obtain an ingot of homogeneous composition having a grain structure;

b) high-speed deforming resulting in a reduction in the grain size;

c) isothermal forging at a temperature between a β transus temperature $T_\beta$ minus 125° C. and the β transus temperature $T_\beta$ minus 25° C., with a strain rate of between $5\times10^{-4}$ $s^{-1}$ and $5\times10^{-2}$ $s^{-1}$; and, d) heat treating comprising the following substeps:

d1) solution treating at a temperature between the β transus temperature minus 35° C. and the β transus temperature plus 15° C., for a time of less than two hours;

d2) aging at a temperature between 750° C. and 950° C. for a time greater than 16 hours to allow growth of the O phase; and, d3) treating within a 100° C. temperature range around a service temperature of said alloy;

wherein said alloy is cooled between substeps d1–d3 at a cooling rate determined depending on the desired service properties of said alloy.

3. An intermetallic alloy as claimed in claim 1, produced by a process, comprising:

a) melting of said composition to obtain an ingot of homogeneous composition having a grain structure;

b) high-speed deforming resulting in a reduction in the grain size;

c) rolling at a strain rate of the order of $10^{-1}$ $s^{-1}$; and, d) heat treating comprising the following substeps:

d1) solution treating at a temperature between a β transus temperature minus 35° C. and the β transus temperature plus 15° C., for a time of less than two hours;

d2) aging at a temperature between 750° C. and 950° C. for a time greater than 16 hours to allow growth of the O phase; and, d3) treating within a 100° C. temperature range around a service temperature of said alloy;

wherein said alloy is cooled between substeps d1–d3 at a cooling rate determined depending on the desired service properties of said alloy.

4. An intermetallic alloy as claimed in claim 1, produced by a process, comprising:

a) melting of said composition to obtain an ingot of homogeneous composition having a grain structure;

b) high-speed deforming resulting in a reduction in the grain size;

c) precision forging at a temperature between a β transus temperature $T_\beta$ minus 180° C. and the β transus temperature $T_\beta$ minus 30° C. to obtain an equiaxial grain structure; and, d) heat treating comprising the following substeps:

d1) solution treating at a temperature close to the forging temperature for a time of less than two hours;

d2) aging at a temperature of between 750° C. and 950° C. for a time greater than 16 hours to allow growth of the O phase; and, d3) treating within a 100° C. temperature range around a service temperature of said alloy;

wherein said alloy is cooled between substeps d1–d3 at a cooling rate determined depending on the desired service properties of said alloy.

5. The intermetallic alloy as claimed in claim 2 or claim 3, wherein said melting is double vacuum arc melting.

6. The intermetallic alloy as claimed in any one of claims 1 to 4, wherein said alloy is subjected to a heat treatment, comprising:

a) solution treating at the β transus temperature minus 25° C. for one hour;

b) aging at a temperature of between 875° C. and 925° C. for 24 hours followed by rapid cooling; and, c) annealing at a service temperature of said alloy.

7. The intermetallic alloy as claimed in claim 6, wherein said annealing is carried out at 550° C. for 48 hours for a service temperature of 550° C.

8. The intermetallic alloy as claimed in claim 6, wherein said annealing is carried out at 650° C. for 24 hours for a service temperature of 650° C.

9. The intermetallic alloy as claimed in claim 1, wherein said alloy is subjected to a heat treatment resulting in a deformability of at least 10% at ambient temperature, said heat treatment comprising:

a) solution treating at a temperature between a β transus temperature minus 35° C. and the β transus temperature minus 15° C. for less than two hours; and, b) aging at a temperature of 900° C.±50° C. for a time greater than 16 hours.

10. The intermetallic alloy as claimed in claim 9, wherein said alloy is annealed within a 100° C. temperature range around a service temperature of said alloy, resulting in additional hardening.

* * * * *